US007341208B2

(12) United States Patent
Peters et al.

(10) Patent No.: US 7,341,208 B2
(45) Date of Patent: Mar. 11, 2008

(54) ATOMIZER FOR MANUAL ACTUATION

(75) Inventors: Ralf-Peter Peters, Bergisch-Gladbach (DE); Joachim Eicher, Dortmund (DE); Holger Hollmann, Gelsenkirchen (DE); Holger Reinecke, Dortmund (DE); Stephen Terence Dunne, Suffolk (GB)

(73) Assignee: Boehringer Ingelheim Microparts GmbH, Dortmund (DE)

( * ) Notice: Subject to any disclaimer, the term of this patent is extended or adjusted under 35 U.S.C. 154(b) by 552 days.

(21) Appl. No.: 10/289,183

(22) Filed: Nov. 7, 2002
(Under 37 CFR 1.47)

(65) Prior Publication Data

US 2003/0209238 A1 Nov. 13, 2003

(30) Foreign Application Priority Data

Nov. 7, 2001 (DE) ..... 101 54 237

(51) Int. Cl.
*B05B 1/34* (2006.01)
*B05B 17/04* (2006.01)

(52) U.S. Cl. ..... 239/468; 239/302; 239/321; 239/11; 239/340; 239/590.3; 239/590.5

(58) Field of Classification Search ..... 239/302, 239/320, 349, 350, 360, 370, 461, 468, 471, 239/472
See application file for complete search history.

(56) References Cited

U.S. PATENT DOCUMENTS 3,185,355 A 5/1965 Lipman
3,771,728 A * 11/1973 Polnauer ..... 239/468
4,071,196 A 1/1978 Burke et al.
4,074,861 A 2/1978 Magers et al.
5,067,655 A 11/1991 Farago et al.
5,405,084 A * 4/1995 Weston et al. ..... 239/11
5,497,944 A * 3/1996 Weston et al. ..... 239/321
5,662,271 A * 9/1997 Weston et al. ..... 239/321
6,413,246 B1 * 7/2002 Harrold ..... 604/298
6,685,109 B2 * 2/2004 Py ..... 239/461
2003/0116650 A1 * 6/2003 Dantes et al. ..... 239/463

* cited by examiner

*Primary Examiner*—Kevin Shaver
*Assistant Examiner*—James S. Hogan
(74) *Attorney, Agent, or Firm*—Oblon, Spivak, McClelland, Maier & Neustadt, P.C.

(57) ABSTRACT

A fluid can be discontinuously atomized with an atomizer of the present invention. The atomizer can include a helical spring, disk spring or gas spring, acting as a pressure spring, as an energy storage device, a cylinder, piston, two ducts and two valves. Atomization can be initiated manually by triggering a locking mechanism. The energy storage device can be disposed outside a storage container for the fluid. The energy storage device can be provided mechanical energy manually. Via the piston, the stored energy can exert pressure onto the fluid in the cylinder, which ranges from 1 MPa to 5 MPa (10 bar to 50 bar). Distribution of the droplet size in the atomized jet can be independent from the level of experience and behavior of the person actuating the atomizer, and can be adjusted in a reproducible manner. The mean droplet diameter can be smaller than about 50 micrometers. The mass flow of the fluid through the nozzle can be less than about 0.4 g/s. The design and function of the atomizer can be adjusted to properties of the fluid, to a planned application, and to a desired manner for handling the atomizer.

23 Claims, 6 Drawing Sheets

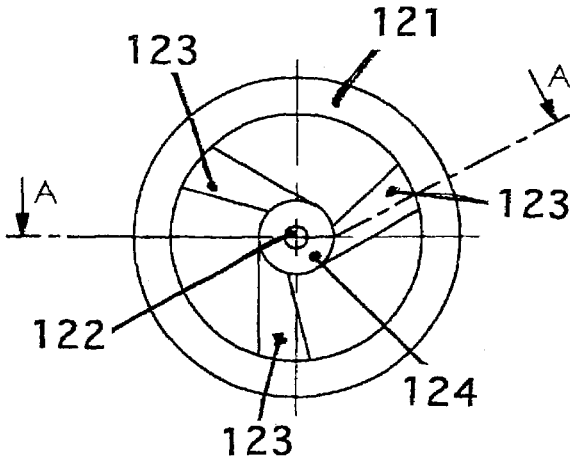
Fig. 7a
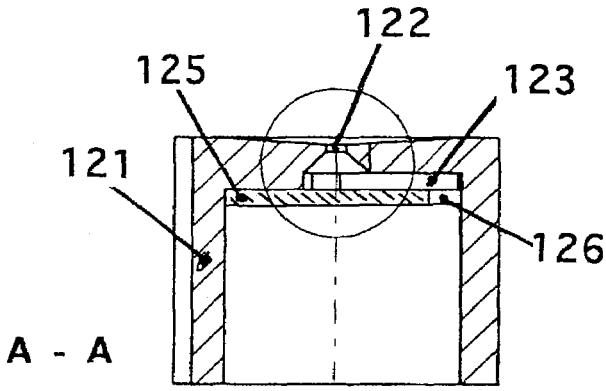
Fig. 7b
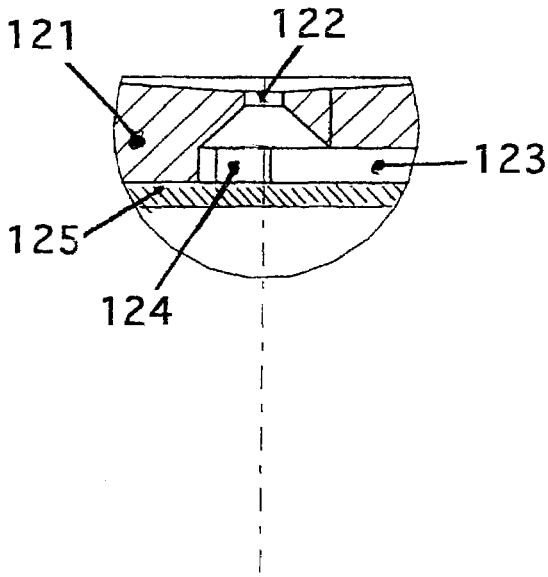
Fig. 7c
Fig. 7

ATOMIZER FOR MANUAL ACTUATION

BACKGROUND OF THE INVENTION

1. Field of the Invention

The invention relates to an atomizer for a fluid whose droplets are precipitated onto a surface. The atomizer can atomize aqueous and non-aqueous fluids, emulsions and suspensions, solutions, dyes and oils. The atomizer can be miniaturized, and it can also contain micro-structured elements.

The atomizer according to the present invention does not require a propellant gas, can be actuated manually, and can be adapted to the properties of various fluids that are to be atomized, as well as to the planned application of the atomized fluid.

2. Description of the Related Art

Atomizers are known where the fluid under pressure contains a propellant (e.g., a liquefied propellant gas) with which the fluid is atomized upon exiting through a nozzle, such as by the influence of the evaporating propellant. Known propellants include gases that are physiologically hazardous, pollute the environment, or are flammable. The container for the fluid must withstand the gas pressure, possibly even at elevated temperatures, and be tight against the gas pressure. If during storage of the container, which is generally filled partially with the fluid, or during usage of the atomizer, the valve on the container is not sufficient gas-tight and the gas pressure drops due to the partially leaking gas, the usefulness of the container or the atomizer can be limited.

Atomizers are known in which the fluid is pushed through a nozzle by a pump, which is manually actuated by the operator, and is thus atomized. The pressure applied to the fluid that is to be atomized, and thus the distribution of the droplet size, is dependent upon the force with which the operator actuates the pump. Thus the pressure at which the fluid is atomized is dependent upon the behavior of the user. Actuation of such an atomizer can be difficult for a person lacking practice when the atomized fluid is supposed to be deposited at a specified location (for example on the skin of the user).

Another known atomizer includes an air pump and a container for the fluid that is to be atomized. The air pump includes a piston, which is moved manually back and forth inside a cylinder. Air flows out from a hole in the bottom of the cylinder. The fluid container is attached to the cylinder, which is equipped with a thin immersion tube, extending into the fluid in the fluid container. The other end of the immersion tube is located directly next to the hole in the bottom of the cylinder. The axis of the immersion tube is vertical in relation to the direction in which the air current exits the cylinder. With sufficient speed of the air flowing out of the container, the fluid experiences a suction effect and is carried along in the air current and atomized. The amount of fluid taken in during one stroke of the piston, and the distribution of the droplet sizes, depends on the speed with which the air exits the hole in the bottom of the cylinder. Both features are difficult to reproduce.

In the known atomizer with a manually actuated pump, the delivery amount and the average droplet size are dependent upon the behavior of the user. The pressure that can be attained is relatively low and is typically less than 0.8 MPa (8 bar). With whirl chamber nozzles, whose outlet orifices have a diameter of more than 300 micrometers, a discharge quantity that is suitable for the application purpose can be achieved with a relatively large mean or average particle size.

A miniaturized high-pressure atomizer is known from WO 97/12687, with which small quantities, e.g. 15 microliters, of a fluid can be atomized at a pressure of 5 to 60 MPa (50 to 600 bar), preferably 10 to 60 MPa (100 to 600 bar). The hydraulic diameter of the nozzle duct is less than 100 micrometers, preferably 1 to 20 micrometers. In the aerosol that is generated, the mean droplet diameter is less than 12 micrometers. The distribution of the droplet size can be adjusted in a reproducible manner. The aerosol can reach the lung, for example through inhaled air. However, the fluid droplets are difficult to precipitate from the air current onto a surface that meets with the aerosol-containing air current.

In WO 97/20590 a locking-stressing mechanism is described, which can be used for stressing a spring in a spring-actuated atomizer. The atomizer contains two housing parts, which are seated rotatable relative to one another. A helical spring is used for example as an energy storage means, which can be manually placed under tension with a screw-thrust transmission means by rotating the two housing parts toward each other. The locking-stressing mechanism is triggered manually by actuating a release button and displaces a piston in a cylinder, thus releasing a partial quantity of a fluid through a nozzle and atomizing it.

BRIEF SUMMARY OF THE INVENTION

The present invention can provide a propellant-free atomizer, with which a partial quantity is atomized from a supply of fluid discontinuously, which is suited for a purely manual actuation, and with which the distribution of the droplet size in the atomized jet can be adjusted in a reproducible manner independent of the experience and the behavior of the person operating the atomizer, and which can include the following elements within a housing:

a storage container and a nozzle for the fluid that is to be atomized as well as a cylinder with a piston that can be displaced therein, a hollow chamber within the cylinder in front of the piston, which is connected with the storage container via an intake duct and with the nozzle via a discharge duct, a valve at least in the intake duct, and a drive device for the piston, wherein the drive device comprises an energy storage means or device for mechanical energy, which is arranged outside the storage container, and the force that is applied by the energy storage device acts upon the piston, and a device for manually feeding mechanical energy into the energy storage device, and the nozzle is a swirl nozzle, which provides the fluid flowing through the nozzle with circulation.

The swirl nozzle can be designed as a spiral housing and contain a whirl chamber, into which the fluid is fed tangential to the inside wall. The fluid exits the nozzle through a nozzle outlet duct, which is located in the center of the whirl chamber. The mean inside diameter of the whirl chamber is larger than the diameter of the outlet duct. On this swirl nozzle, an angle of about 90 degrees is formed between the direction of the fluid that is introduced into the whirl chamber and the direction of atomized jet leaving the nozzle.

In another embodiment, the swirl nozzle can contain a cylindrical hollow chamber, in which a cylindrical body is incorporated. In the intermediate space between the exterior of the cylindrical body and the interior of the hollow chamber of the swirl nozzle a guiding mechanism in the form of a helix is integrated. The fluid is introduced parallel to the axis of this swirl nozzle. Due to the guiding mechanism, the fluid experiences circulation. The fluid exits through a nozzle outlet duct, which is located on the axis of the swirl nozzle. In the swirl nozzle the outlet direction of the fluid is parallel to the inlet direction of the fluid. The guiding mechanism includes a bar that is wound helically, which is preferably arranged on the shell area of the cylindrical body and rests tightly against the inside wall of the cylindrical hollow chamber. The bar can take on the shape of a single-thread or a multiple-thread screw.

The nozzle duct of the swirl nozzle can have a diameter of between about 30 micrometers to about 300 micrometers, preferably from between about 50 micrometers to about 150 micrometers. The nozzle duct can have a length of between about 10 micrometers to about 1000 micrometers, preferably from between about 50 micrometers to about 300 micrometers. The mean inside diameter of the whirl chamber in the swirl nozzle or the diameter of the cylindrical hollow chamber of the swirl nozzle can be between about two (2) to about ten (10) times, and preferably between about two-and-a-half (2.5) to about five (5) times, as large as the diameter of the nozzle duct.

The drive device for the piston includes a storage unit for mechanical energy. The energy storage device can be a spring, preferably a helical spring or disk spring, which acts as a pressure spring. The spring can include metal or polymer. A gas spring can also be used, preferably a hermetically closed roll bellows gas spring.

These springs can be pre-stressed during installation in the atomizer. The helical spring and the disk spring are brought to the specified spring tension. The gas spring is compressed to the desired gas pressure.

The spring is placed under tension manually (i.e., a length of the spring is decreased to compress the spring). The spring, acting as a working spring, stores the energy used for displacing the piston inside the cylinder for ejecting and atomizing the fluid.

For the purpose of stressing the working spring, the piston can be equipped with a rod, which protrudes out of the housing. When the rod is manually pulled out of the housing with a handle to a certain degree, the working spring is simultaneously stressed, the piston is pulled out of the cylinder to a certain degree, and fluid is sucked into the chamber within the cylinder from the storage container.

Furthermore the working spring can be placed under tension by pushing the housing together, possibly with only one hand, when the housing includes two parts, which are connected with each other and are rotatable relative to each other axially.

If the force used for stressing the working spring manually is large, the housing of the atomizer can include two parts, which are connected with each other and are rotatable relative to each other. The drive device can include a screw-thrust transmission means, via which the necessary mechanical energy is fed manually to the energy storage device. The two housing parts are turned manually relative to each other. The screw-thrust transmission means stresses the working spring. For force transformation purposes a force is required that is smaller than the force that is required for pulling out the rod that is attached to the piston in the axial direction.

The energy stored in the working spring exerts onto the partial quantity of fluid inside the cylinder a pressure that ranges from between about 0.5 MPa to about 5 MPa (from 5 bar to 50 bar), preferably from between about 2 MPa to about 3 MPa (from 20 bar to 30 bar).

The drive device can be equipped with a locking mechanism, which includes a locking member and a release button and which keeps the piston in a specified position upon stressing the working spring. This way, a period of time can pass between manually tensioning the working spring and triggering the atomizing process by actuating the release button. During this period of time the atomizer can be brought from the position that is used for the manual stressing of the working spring into the position in which the atomizer is used during the atomizing process.

The drive device with locking mechanism can be designed as a locking-stressing mechanism, which automatically assumes the locking state when the piston reaches a specified position during the tensioning process of the working spring.

In a drive device without locking mechanism, the atomizing process directly follows the process of placing the working spring under tension if, in the ejection duct for the fluid, no valve or an automatically operating valve is installed. The effect of a drive device with locking mechanism can also be accomplished when a valve is incorporated in the ejection duct that is opened manually for the fluid.

The atomizer can include a valve at least in the intake duct, preferably an automatically operating valve. The automatic valve opens at low pressure as the piston is pulled out of the cylinder when stressing the working spring. This valve closes when the piston is pushed into the cylinder by the working spring, and the atomizing process begins. This valve prevents fluid from flowing back into the storage container during the atomizing process.

In the ejection duct another valve (e.g. an ejection valve) can be used if air is simultaneously taken in through the ejection duct in the case of a relatively large cross-section of the nozzle duct in the swirl nozzle during the intake process of fluid from the storage container. This valve can be an automatically operating valve, which prevents the intake of air through the swirl nozzle. The valve opens as the piston begins expelling the fluid through the ejection duct.

The valve in the ejection duct can be a non-automatic valve, which is not opened by the maximum pressure generated by the piston, but opens upon manual actuation. Such a valve in the ejection duct has a similar effect on the handling of the atomizer as does a locking mechanism in the drive device. The fluid located in the cylinder can be atomized between two stressing processes of the working spring, successively in smaller quantities. The valve in the ejection duct can be operated successively several times. The user can determine the amount of fluid that is atomized during each actuation of the valve in the ejection duct to the particular requirements. However, the working spring is placed under tension again when the fluid in the cylinder has been completely ejected the working spring can be stressed before the fluid located in the cylinder has been completely ejected.

In another embodiment of the atomizer, the path of the piston can be shorter than the path by which the working spring is compressed during the tensioning process. When pulled out, the piston impacts with a stop before the working spring is compressed in the manner specified. In the stressed state of the working spring, an intermediate space is created between the movable end of the working spring and the outside of the piston. When triggering the working spring, the working spring exerts an impact on the piston when the movable end of the working spring rests against the outside of the piston. Thus, a pressure surge can be exerted on the fluid in the cylinder.

In the case of an atomizer that is equipped with an automatically operating valve in the ejection duct, the locking mechanism can be equipped with a stop device, which stops the motion of the piston once or more after the piston has traveled a specified distance and before the entire fluid contained in the cylinder has been ejected. Thus, the fluid contained in the cylinder can be ejected successively in several portions, which can be adjusted in a reproducible manner, and be atomized. The atomizer can be actuated several times between two tensioning processes of the working spring. The stop device can stop the motion of the piston at previously established and subsequently fixed positions of the piston. The stop device can be adjusted and actuated from the outside. Thus, the positions of the piston at which the stop device stops its motion can be subsequently adjusted and modified.

In order to place the partial quantity of fluid removed from the storage container under pressure, a device with a movable bellows can also be used. The bellows is stretched by a tensile force, thus increasing its volume and extracting a portion of the fluid from the storage container via an intake duct and an automatically acting valve. When pressing the bellows together in the longitudinal direction, the pressure on the fluid contained therein is increased until the automatically acting valve located in the ejection duct opens and fluid is expelled through a nozzle and atomized.

A single-jet nozzle with a single nozzle duct, which can include a baffle element that is arranged in front of the nozzle, or a multiple-jet nozzle with several parallel or crossing fluid jets, can be used as atomizing nozzles.

The single-jet nozzle contains a single nozzle duct, which has a hydraulic diameter of between about 10 micrometers to about 200 micrometers, and which is between about 20 micrometers to about 1000 micrometers long.

The multiple-jet nozzle can contain several nozzle ducts, the axes of which can run parallel to each other. This way the amount of fluid to be atomized within a specified time can be increased. Furthermore the cross-sectional surface of the atomized jet can be increased, or the shape of the spray pattern can be adjusted to a specified shape. The hydraulic diameter of the nozzle ducts can be the same in all ducts of a multiple-duct nozzle and range from between about 10 micrometers to about 200 micrometers, with a duct length of between about 20 micrometers to about 1000 micrometers, respectively. However, different diameters for the ducts can be used in a multiple-jet nozzle.

The multiple-jet nozzle can also contain at least two nozzle ducts that are tilted relative to each other, which direct the fluid jets to a point in front of the nozzle's exterior at which the fluid jets rebound with each other. The angle between two tilted fluid jets can be between about 30 degrees to about 120 degrees. Due to the rebounding of several fluid jets with each other, atomization can be promoted. The hydraulic diameter of the two nozzle ducts in a two-jet nozzle is preferably less than about 180 micrometers, and is preferably between about 70 micrometers to about 100 micrometers, with a duct length from between about 20 micrometers to about 1000 micrometers, respectively.

A baffle element which rebounds with the fluid jet can be arranged at a distance of between about 0.1 millimeters to about 5 millimeters in front of the nozzle opening. A spherical or hemispherical object can be used in the baffle element, with a diameter of between about 0.1 millimeters to about 2 millimeters. In the case of a hemi-spherical ball, the fluid jet preferably rebounds on the convex side. Furthermore a baffle plate or a baffle cone can be used, wherein the fluid jet strikes the baffle plate vertically or at the tip of the cone, for example. A baffle element can promote atomization of the fluid. The baffle element can also create a largely ring-shaped spray pattern. The direction of the atomized jet can be inclined towards the axis of the nozzle ducts when the jet before atomization rebounds at an angle with the plate. Where several nozzle ducts are arranged parallel to each other, one or more baffle elements can be provided, which can influence the shape and size of the atomized jet and the direction of the atomized jet.

The baffle element can be fastened to the housing of the atomizer with at least one fastening element. Suitable fastening elements include a rigid wire or a rod. However, the baffle element can be fastened to the housing with two or three fastening elements. If the length of the fastening elements is varied, the distance from the baffle element to the outside of the nozzle can be changed.

The mass flow rate occurring in the nozzle duct of the atomizer according to the invention can be less than about 0.4 grams per second. The mean droplet diameter can be less than about 50 micrometers.

The atomizer of the present invention can provide the following advantages:

The sequence of the atomization process, the mass flow of the fluid through the nozzle duct and the distribution of the droplet size are independent of the force applied by the user when stressing the working spring. These features are established by the design of the atomizer and are reproducible.

Alcohol or other volatile hydrocarbon compounds are not required for atomizing the fluid.

The jet exiting the atomizer can include only the air carried along from the surroundings as a gas component.

The distribution of the droplet size and the mass flow of the fluid exiting the atomizer can result in an atomized fluid jet that is suited for the precipitation of droplets on a surface that is struck by the atomized fluid jet.

The atomizer can be manufactured in various versions and be adapted to the intended application purpose and for favorable handling.

Examples of the atomizer according to the present invention are explained in more detail based on the following figures.

BRIEF DESCRIPTION OF THE SEVERAL VIEWS OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 7*a* shows a partial top view of a whirl chamber nozzle.

FIG. 7*b* shows a longitudinal cross-sectional view of the whirl chamber nozzle along the line A-A of FIG. 7*a*.

FIG. 7*c* shows an enlarged view of the nozzle duct of FIG. 7*b*.

DETAILED DESCRIPTION OF PREFERRED EMBODIMENTS OF THE INVENTION

Figure 2:
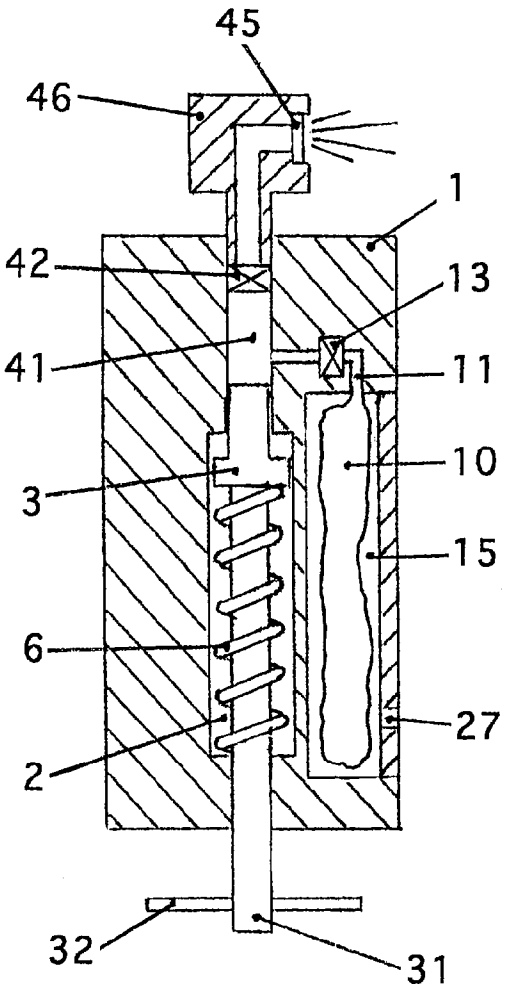
FIG. 2 shows a longitudinal cross-sectional view of another embodiment of the atomizer.

Referring now to the drawings, wherein like reference numerals designate identical or corresponding parts throughout the several views, an example of the present invention is described below referring to the figures.

Figure 1:
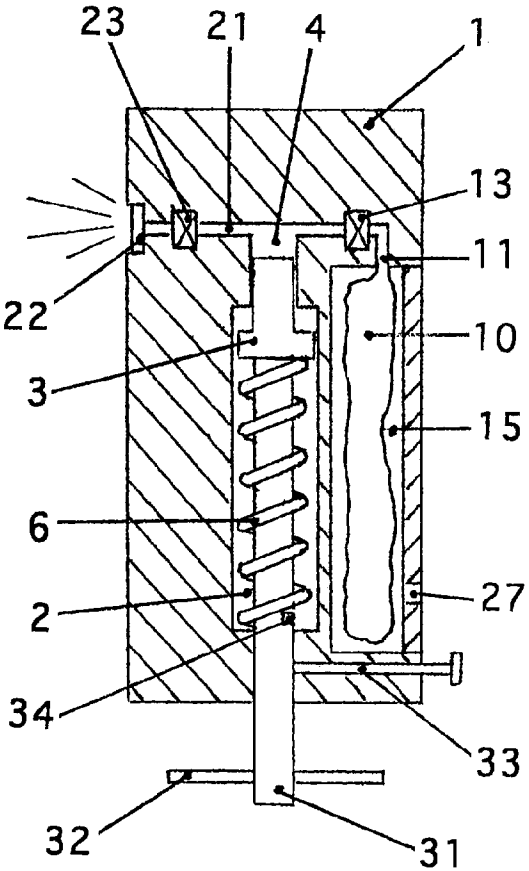
FIG. 1 shows a longitudinal cross-sectional view of an atomizer according to the present invention.

FIG. 1 shows a helical spring, which can be stressed manually with a handle that is attached to the outside of a housing by pulling the handle out, provided as a storage device for mechanical energy (working spring). A notch is provided in a rod that connects the handle with a piston, with which a spring-loaded stud engages at the end of the stressing process of the helical spring, thus keeping the rod in the position reached. Pulling the stud out of the notch triggers the atomization process. A collapsible bag can be used as a storage container for the fluid. FIG. 1 shows the atomizer in an intermediate stage that occurs between (i) when the piston is pulled out of the housing to a first stop and (ii) when the piston is pushed into the cylinder up to a second stop. In the embodiment, the helical spring expels the fluid out of the nozzle.

The housing 1 of a rigid material contains a hollow chamber 2, in which a pre-stressed helical spring 6 is disposed. The helical spring 6 is supported on one end by the bottom of the hollow chamber 2, and pushes with the other end on a piston 3. A thinner part of the piston 3 is displaceable in the cylinder and sealed against a cylinder wall. A hollow chamber 4 is located within the cylinder in front of the thinner part of the piston 3, into which fluid can be drawn. The hollow chamber 4 is connected with a storage container 10 for the fluid that is to be atomized via an intake duct 11. The intake duct 11 can include an automatically operating spring-loaded intake valve 13, through which the fluid can flow out of the storage container into the hollow chamber 4 during the intake process. The storage container 10 can be a collapsible bag, which is arranged in a hollow chamber 15 within the housing 1. The hollow chamber 15, which is closed with a cover, is provided with an opening 27, through which ambient air can flow in to compensate for differences in pressure caused by a decrease in the volume of the collapsible bag. The hollow chamber 4 is connected with the nozzle 22 via the ejection duct 21. The ejection duct can include a spring-loaded valve 23, which opens when the fluid that is to be atomized is disposed in front of the valve and has a sufficient high pressure. On its thicker end, the piston 3 is connected with a rod 31, which is surrounded by the helical spring and protrudes from a bottom of the housing. An end of the rod 31 is connected with a handle 32, with which the piston 3 can be pulled manually out of the cylinder to a specified degree or distance, such that the helical spring is tensioned (i.e., a length that the spring is decreased) simultaneously. A stud 33 is arranged on the bottom of the housing, which keeps the rod 31 and thus the piston 3 in the specified positions when the piston is pulled a specified distance out of the housing.

For subsequent stressing of the helical spring 6, the rod 31 and the piston 3 are pulled out by the handle 32 until the stud 33 snaps into a notch 34. By pulling the piston 3 back, a volume of the chamber 4 within the cylinder is increased. Fluid is sucked into the chamber 4 from the storage container 10 via the intake duct 11 when the valve 13 is open. The closed valve 23 prevents air from entering the chamber 4.

The rod 31 can be pulled back with a lever (not shown) that is accessible from the outside and that can be manually operated, whereby the spring is stressed and the chamber 4 fills with fluid. Upon releasing the lever, the tensioned spring concurrently pushes the fluid out of the chamber 4 through the nozzle 22 and atomizes the fluid. Thus, neither the stud 35 nor the notch 34 is required. In this embodiment, the atomizer operates similar to a manually operated pump atomizer (finger pump). The pressure exerted on the fluid contained in the chamber 4 within the cylinder, however, is generated by the tensioned spring in the atomizer, and thus the user has no influence on the exerted pressure.

FIG. 2 shows another embodiment of the atomizer. In this embodiment, the valve in the ejection duct does not open automatically in response to a high fluid pressure in front of the valve. Rather, the valve in the ejection duct is actuated manually, preferably by pushing the valve down. FIG. 2 shows the atomizer in an intermediate stage, between (i) the piston having been pulled out of the housing to a first stop and (ii) the piston having been pushed into the cylinder up to a second stop.

This atomizer includes features similar to the atomizer of FIG. 1. However, this embodiment does not include a stud 33 and a notch 34. A valve 42 duct that can be opened manually is disposed in the ejection duct. The atomizer is actuated in two steps. First the spring 6 is stressed by pulling out the rod 31. At the same time the chamber 41 is filled with fluid from the storage container 10. In the state shown in FIG. 2, the helical spring pushes the fluid against the valve 42 when the valve 42 is closed. When the valve 42 is opened manually, for example by pushing down the release button 46, the fluid flows through the nozzle 45 that is disposed in the release button 46 and is atomized. Thus, the user can allow some time to pass between (i) placing the spring under tension and the associated subsequent processes and (ii) actuating the release button 46. The user's attention can be focused on the precipitation of the atomized fluid onto the surface that is to be treated.

Figure 3:
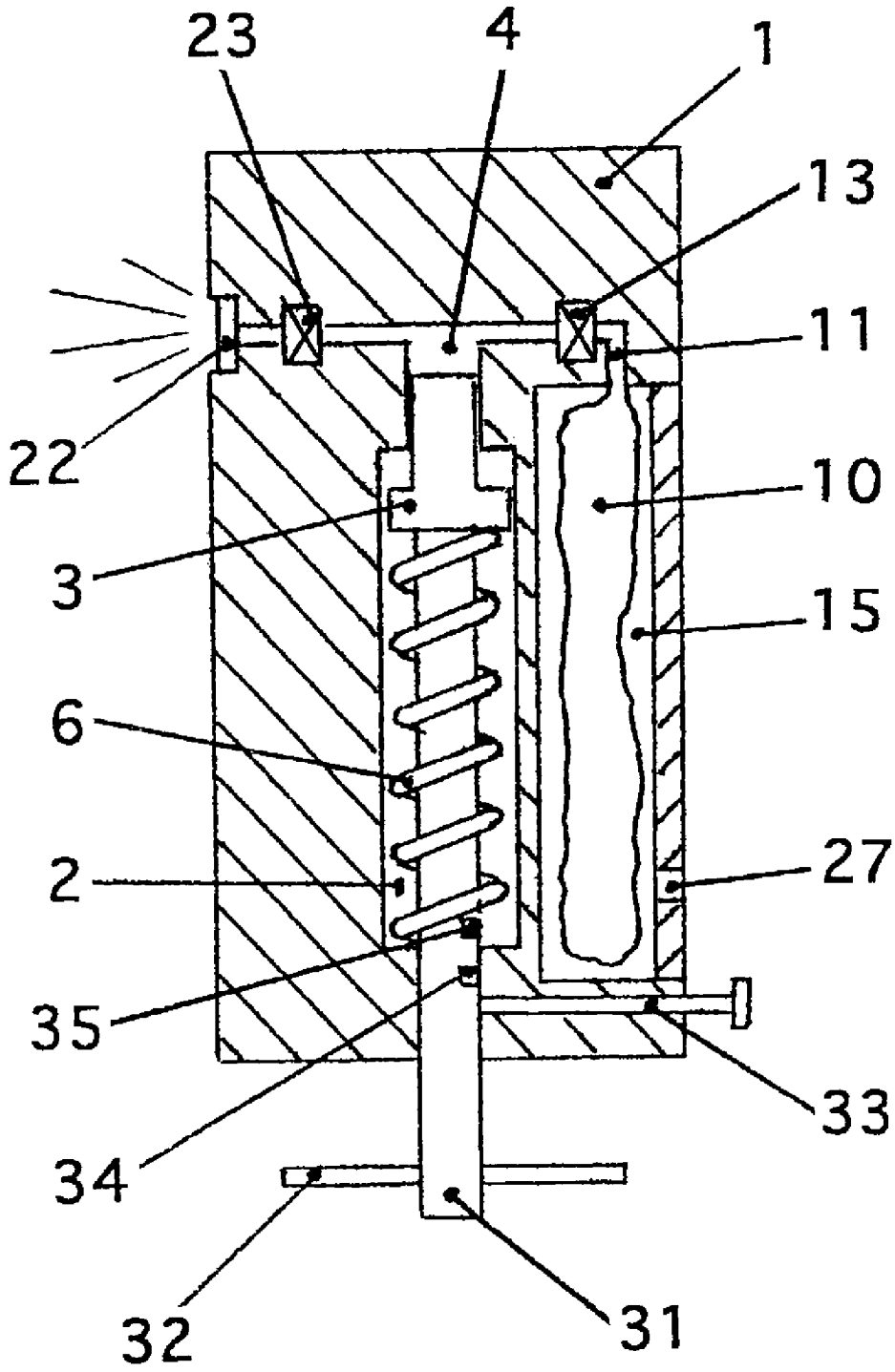
FIG. 3 shows a longitudinal cross-sectional view of another embodiment of the atomizer.

FIG. 3 shows another embodiment of the atomizer, which can be actuated twice between two stressing processes of the spring, and which expels and atomizes the fluid that is available within the cylinder in two partial quantities. The rod 31 that is connected with the piston 3 includes two notches 34 and 35, which are arranged at a specified distance from each other. The notches 34, 35 preferably have a saw-tooth shape that, when viewed from the handle 32, includes an edge of the tapered surface that is disposed behind the edges that are aligned vertically with an axis of the rod 31. The stud 33 can also include a corresponding saw-tooth shaped end. When pulling out the rod 31, the stud 33 can be pulled out of the notch 34 and disposed in the notch 35. Subsequently, when the spring-loaded stud 33 is pulled out of the notch 35 manually and released, the spring 6 pushes the fluid located within the cylinder and pushes the first partial quantity of the fluid through the automatically operating valve 23 to the nozzle 22, in front of which the exiting fluid is being atomized. This first process is completed when the stud 33 snaps into the notch 34. The second process takes place similar to the first process. The second process commences when the stud 33 is pulled manually out of the notch 34, and ends when the piston reaches its end position.

Figure 4:
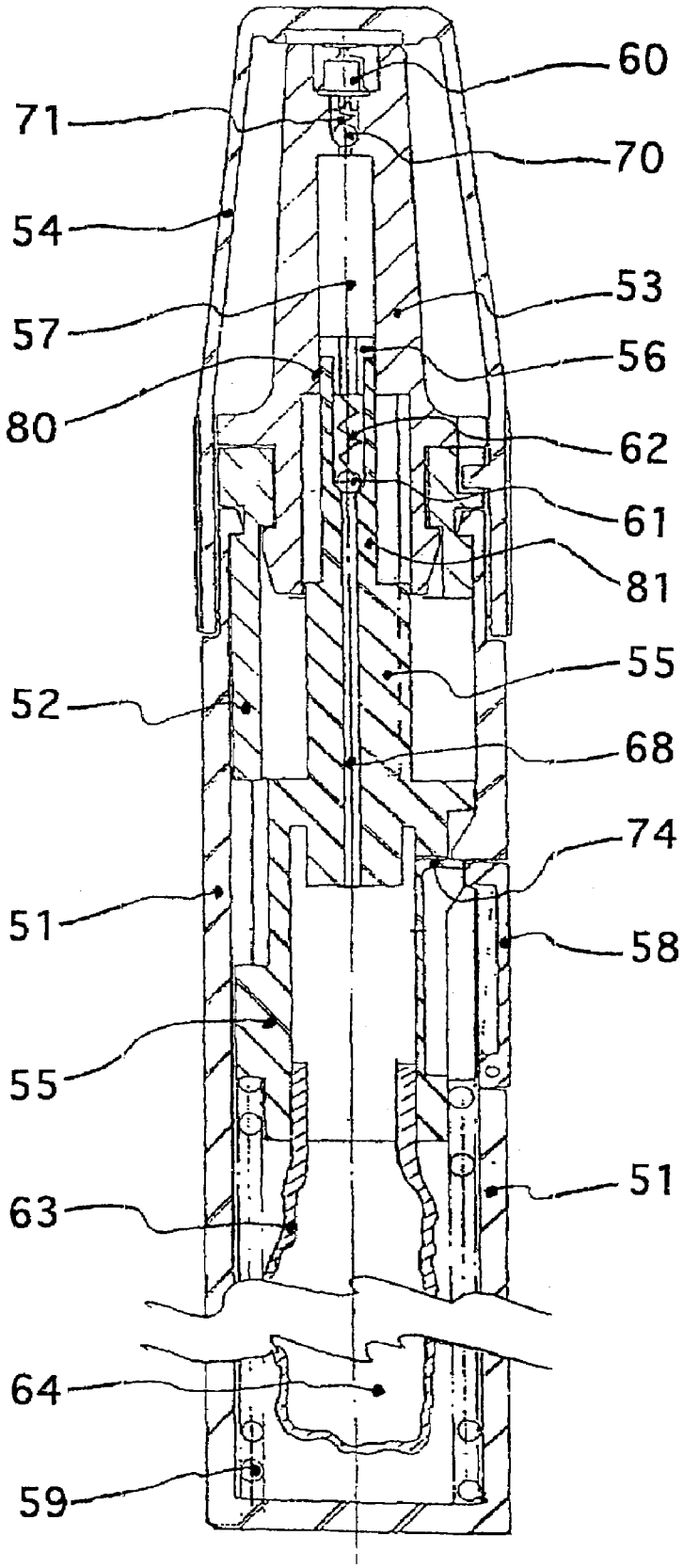
FIG. 4 shows a longitudinal cross-sectional view of another embodiment of the atomizer.

FIG. 4 shows another embodiment of the atomizer including a working spring as a storage device for mechanical energy. The working spring is stressed manually through a locking-stressing mechanism, which contains a screw-thrust transmission device, by rotating the two parts of the housing, which are connected rotatably relative to each other. The atomization process is triggered by actuating a release button for a pawl. FIG. 4 shows the atomizer with a stressed helical spring and snapped in pawl as well as with a chamber within the cylinder completely filled with fluid before triggering the atomizing process by actuating a release button.

The atomizer has a cylindrically shaped housing. A lower housing part 51 is rotatably connected with an upper part 52 of the atomizer via a snap-fit connection. The upper part contains a cylinder 53 and a nozzle 60. The upper part is equipped with a removable protective cap 54. By rotating the cap 54 and the thereto connected upper part 52 of the atomizer, a component 55, which is arranged in the lower housing part 51 in an axially displaceable manner and contains the piston 81, is pushed away from the cylinder 53 with a screw-thrust transmission device until a pawl 74 that is arranged in the component 55 is engaged behind a protrusion in the lower housing part 51. During this process, a volume of the chamber 57 within the cylinder is increased. Concurrently, a portion of the fluid 64 is sucked into the chamber 57 from the storage container 63, which can be designed as a collapsible bag, through the duct 68 in the tubular piston 81, and the helical spring 59 is stressed. An automatically operating valve can be disposed in the duct that connects the chamber 57 with the nozzle 60, which includes a ball 70 loaded with a spring 71. The valve prevents air from entering the chamber 57 while receiving the fluid, thereby filling the chamber 57 with fluid that is bubble-free. A valve is attached on an end of the tubular piston 81 that is located within the cylinder 53, which includes of a ball 61 loaded with the spring 62. The spring 62 is kept in its position by a plug that is pushed into the end of the tubular piston 81. The plug can include a duct, through which the fluid flows into the chamber 57. An upper edge 56 of the plug can act to seal the piston 81 against the cylinder 53. The valve on the inner end of the tubular piston 81 can open automatically when fluid is received and can close when fluid is expelled through the nozzle.

To atomize the fluid contained in the chamber 57 within the cylinder, the protective cap 54 is removed and the release button 58 located in the lower housing part is actuated manually to disengage the pawl 74. The stressed helical spring 59 places the fluid contained in the chamber 57 under pressure. The valve that is arranged in front of the nozzle opens automatically. The fluid in the chamber 57 is expelled through the nozzle 60 and atomized. During the process of ejecting the fluid, the valve that is attached on the end of the tubular piston is closed, preventing fluid from flowing out of the chamber 57 back into the storage container 63. After the atomization process has been completed, the protective cap 54 is replaced on the upper part of the atomizer.

When the valve is opened manually in front of the nozzle during actuation, a release button similar to that shown in FIG. 2 can be used in place of the release button 58, the pawl 74 and the automatically operating valve with ball 70 and spring 71. The release button can be arranged on the upper end of the atomizer.

A closed container that cannot be deformed and that is equipped with an automatically operating ventilation valve as well as with a immersion tube extending into the container, possibly in the form of a pipe coil, can be used in place of the collapsible bag 63. The seal of the tubular piston against the cylinder by the upper edge 56 of the plug can be replaced with an O-ring, which is attached in a groove in the lower end of the cylinder in a certain place or channel 80.

In another embodiment of the atomizer, the component 55 including the tubular piston can be connected with the lower housing part, and the cylinder with the chamber 57 can be arranged displaceably in the axial direction in relation to the lower housing part 51. For easier handling of the atomizer, a multi-tooth pawl can be provided, which is constantly being snapped into portions of the housing during stressing of the helical spring.

If a relatively great force is required for tensioning the helical spring, a screw-thrust transmission device can be used, which can be rotated through more than 360 degrees. This allows for the requisite manually applied force that is required for placing the helical spring under tension by rotating the two housing parts relative to each other to be reduced considerably.

Figure 5:
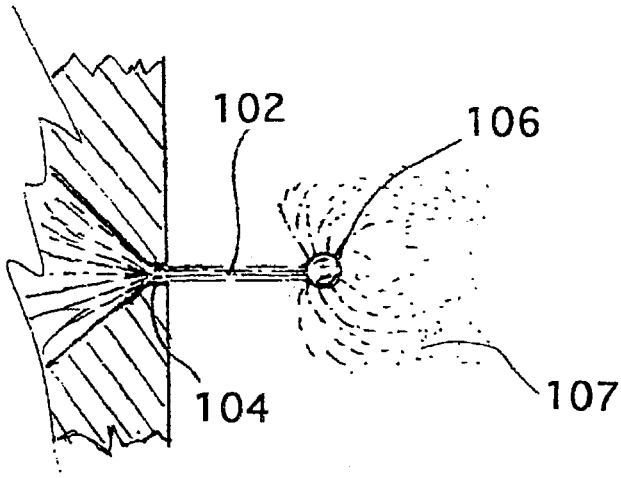
FIG. 5 shows a cross-sectional view of a nozzle including a ball as a baffle element.

FIG. 5 shows a cross-section through a nozzle with a ball that is arranged outside and in front of the nozzle as a baffle element. The fluid under pressure is expelled through the nozzle opening 104 in the shape of a closed jet 102, which rebounds with a baffle element 106. During this process, the fluid passes into the atomized jet 107.

Figure 6:
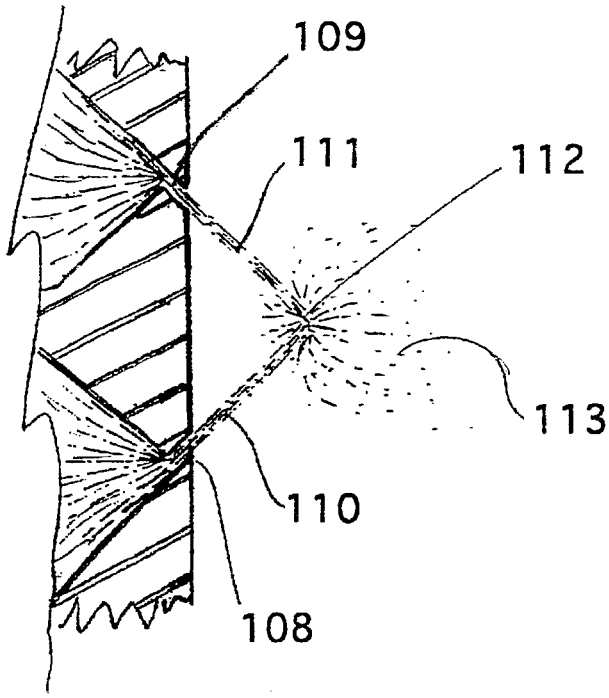
FIG. 6 shows a cross-sectional view of a nozzle including two nozzle ducts tilted relative to each other.

FIG. 6 shows a cross-section through a nozzle with two nozzle ducts that are tilted relative to each other. The two fluid jets expelled from the nozzle rebound with each other outside the nozzle. The fluid under pressure is ejected out of the two nozzle openings 108 and 109 in the form of two closed jets 110 and 111. Both jets rebound with each other at a point 112. During this process, the fluid passes into the atomized jet 113.

FIG. 7 shows a swirl nozzle in the form of a whirl chamber nozzle. FIG. 7*a* shows a view of the whirl chamber nozzle from inside with the cover plate removed. FIG. 7*b* shows a longitudinal section through the whirl chamber nozzle along the line A-A in FIG. 7*a* and parallel to the nozzle axis. In FIG. 7*c*, the area around the nozzle duct is shown in an enlarged view.

Within the whirl chamber nozzle 121, the nozzle duct 123 aligned with an axis of the whirl chamber nozzle duct 122, and the fluid that is to be atomized is guided through three ducts 123, for example, tangentially into the whirl chamber 124. The axes of the nozzle ducts 123 intersect the axis of the whirl chamber nozzle duct 122. The nozzle ducts 123 are shown enlarged relative to the whirl chamber nozzle duct 122. The cover plate 125 for the whirl chamber nozzle duct 122 and the nozzle ducts 123 includes an opening 126 in the area of an outer end of the nozzle ducts 123, respectively, through which the fluid enters the nozzle ducts 123.

Figure 8A:
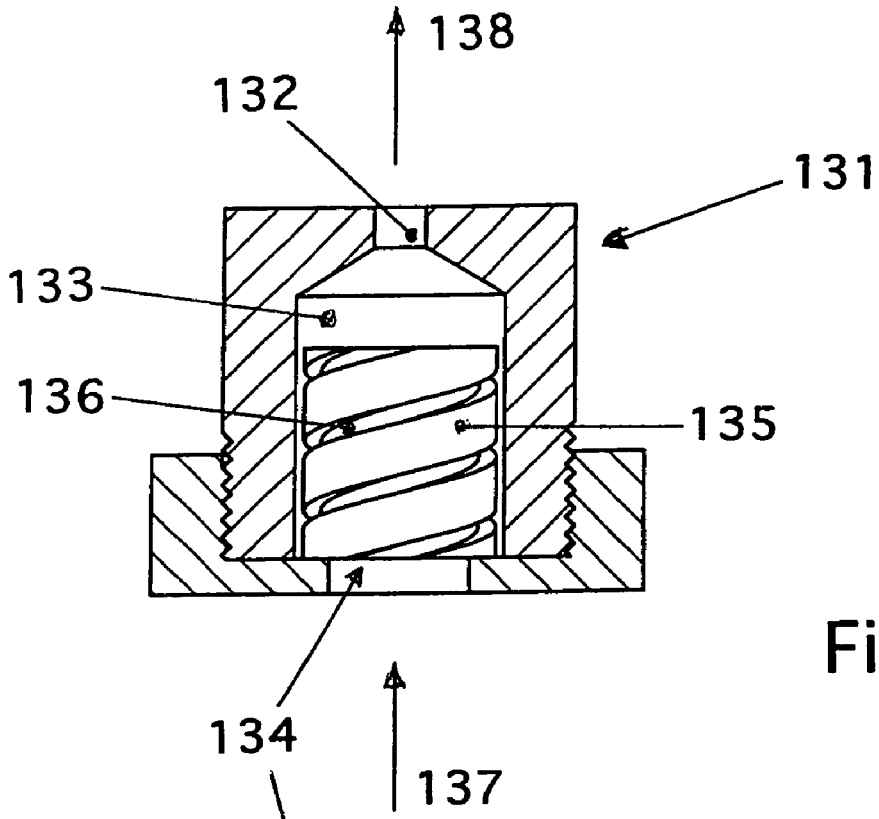
FIG. 8*a* shows a longitudinal cross-sectional view of the second embodiment of the swirl nozzle.

FIG. 8*a* shows a longitudinal cross-section through the swirl nozzle 131 having the outlet duct 132. Within the cylindrical hollow chamber 133 of the swirl nozzle the cylindrical body 134 is incorporated. This body includes a helically wound bar 135 in the shape of for example a double-thread screw. The fluid is guided by helically wound grooves 136 and experiences circulation. The inlet direction 137 of the fluid to be atomized is parallel to its outlet direction 138.

Figure 8B:
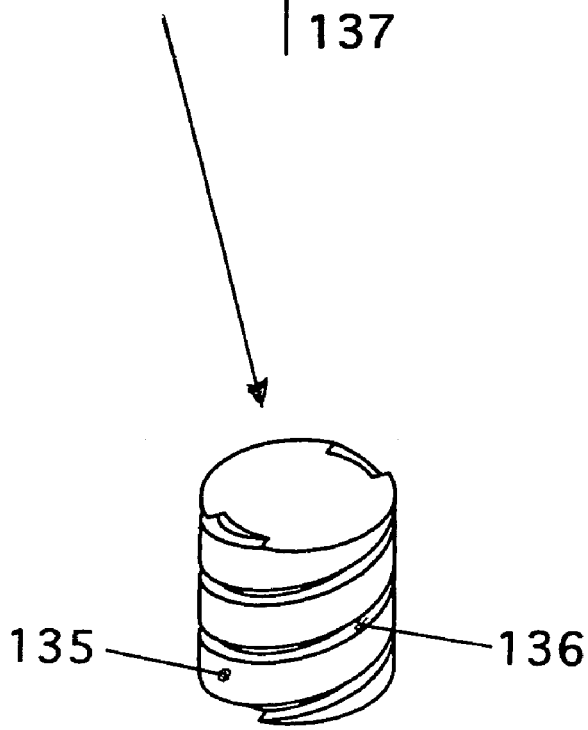
FIG. 8*b* shows an oblique view of the cylindrical body incorporated in the chamber of the second embodiment of the swirl nozzle.

FIG. 8*b* shows an oblique view of the cylindrical body 134 incorporated in the chamber of the second embodiment of the swirl nozzle. The surface of body 134 includes a helical guiding channel in the shape of a double-thread screw.

Obviously, numerous additional modifications and variations of the present invention are possible in light of the above teachings. It is therefore to be understood that within the scope of the appended claims, the present invention may be practiced otherwise than as specifically described herein.

The invention claimed is:

1. An atomizer for manual actuation, with which a partial quantity is atomized from a fluid supply and which comprises within a housing:

a storage container for the fluid that is to be atomized;

a nozzle for the fluid that is to be atomized;

a piston displaceable within a cylinder;

a hollow chamber within the cylinder in front of the piston;

an intake duct connecting the storage container with the hollow chamber;

an ejection duct connecting the hollow chamber with the nozzle;

an intake valve disposed in the intake duct;

a drive device for the piston; and a device for manually providing mechanical energy into the drive device, wherein the drive device comprises a storage device for mechanical energy and is arranged outside the storage container, the drive device applying the mechanical energy to the piston, and wherein the nozzle comprises a swirl nozzle including a whirl chamber, nozzle ducts, and a whirl chamber nozzle duct, the nozzle ducts having a wall tangential to an inside wall of the whirl chamber to guide the fluid into the whirl chamber in a direction tangential to the inside wall, and the whirl chamber nozzle duct being located in a center of the whirl chamber and from which the fluid exits.

2. The atomizer according to claim 1, wherein the diameter of the whirl chamber nozzle duct is between about 50 micrometers to about 150 micrometers.

3. The atomizer according to claim 1, wherein an inside diameter of the whirl chamber is larger than a diameter of the whirl chamber nozzle duct, and wherein a length of the whirl chamber nozzle duct is between about 10 micrometers to about 1000 micrometers.

4. An The atomizer according to claim 1, wherein an inside diameter of the whirl chamber is larger than a diameter of the whirl chamber nozzle duct, and wherein the inside diameter of the whirl chamber is between about two to about to ten times the diameter of the whirl chamber nozzle duct.

5. The atomizer according to claim 4, wherein the inside diameter of the whirl chamber is between about two-and-a-half times to about five times the diameter of the whirl chamber nozzle duct.

6. The atomizer according to claim 1, wherein the piston is equipped with a rod protruding from the housing, via which the mechanical energy is provided manually to a working spring by pulling out the rod.

7. The atomizer according to claim 1, wherein the piston is displaceable along a stroke including least two stages.

8. The atomizer according to claim 1, further comprising:

an ejection valve disposed in the ejection duct.

9. The atomizer according to claim 8, wherein the intake valve and the ejection valve comprise automatically operating valves.

10. The atomizer according to claim 8, wherein the intake valve comprises an automatically operating valve and the ejection valve comprises a manually actuated valve.

11. The atomizer according to claim 1, wherein an inside diameter of the whirl chamber is larger than a diameter of the whirl chamber nozzle duct, and wherein the diameter of the whirl chamber nozzle duct is between about 30 micrometers to about 300 micrometers.

12. An atomizer for manual actuation, with which a partial quantity is atomized from a fluid supply and which comprises within a housing:

a storage container for the fluid that is to be atomized;

a nozzle for the fluid that is to be atomized;

a piston displaceable within a cylinder;

a hollow chamber within the cylinder in front of the piston;

an intake duct connecting the storage container with the hollow chamber;

an ejection duct connecting the hollow chamber with the nozzle;

an intake valve disposed in the intake duct;

a drive device for the piston; and a device for manually providing mechanical energy into the drive device, wherein the drive device comprises a storage device for mechanical energy and is arranged outside the storage container, the drive device applying the mechanical energy to the piston, wherein the nozzle comprises a swirl nozzle including a cylindrical hollow chamber in which a cylindrical body is present, and wherein a helical guiding mechanism is disposed in an intermediate space between an outside of the cylindrical body and an inside of the cylindrical hollow chamber of the swirl nozzle, and the fluid is introduced parallel to an axis of the swirl nozzle and exits through an outlet duct, which is disposed on the axis of the swirl nozzle.

13. The atomizer according to claim 12, wherein a diameter of the outlet duct is between about 50 micrometers to about 150 micrometers.

14. The atomizer according to claim 12, wherein a length of the outlet duct is between about 10 micrometers to about 1000 micrometers.

15. The atomizer according to claim 12, wherein a diameter of the cylindrical hollow chamber is between about two to about ten times the diameter of the outlet duct.

16. The atomizer according to claim 15, wherein the diameter of the cylindrical hollow chamber is between about two-and-a-half times to about five times the diameter of the outlet duct.

17. The atomizer according to claim 12, wherein a diameter of the outlet duct is between about 30 micrometers to about 300 micrometers.

18. An atomizer for manual actuation, with which a partial quantity is atomized from a fluid supply and which comprises within a housing:

a storage container for the fluid that is to be atomized;

a nozzle for the fluid that is to be atomized;

a piston displaceable within a cylinder;

a hollow chamber within the cylinder in front of the piston;

an intake duct connecting the storage container with the hollow chamber;

an ejection duct connecting the hollow chamber with the nozzle;

an intake valve disposed in the intake duct;

a drive device for the piston; and a device for manually providing mechanical energy into the drive device, wherein the drive device comprises a storage device for mechanical energy and is arranged outside the storage container, the drive device applying the mechanical energy to the piston, wherein the nozzle comprises a swirl nozzle providing the fluid flowing through the nozzle with circulation, and wherein the housing comprises two parts connected with each other arranged to rotate relative to each other, and the drive device comprises a screw-thrust transmission device, via which a working spring is manually fed the mechanical energy by rotating the two housing parts relative to each other.

19. The atomizer according to claim 18, wherein the drive device further comprises a locking mechanism including a locking member and a release button that holds the piston in a state where energy is stored in the storage device.

20. An atomizer for manual actuation, with which a partial quantity is atomized from a fluid supply and which comprises within a housing:

a storage container for the fluid that is to be atomized;

a nozzle for the fluid that is to be atomized;

a piston displaceable within a cylinder;

a hollow chamber within the cylinder in front of the piston;

an intake duct connecting the storage container with the hollow chamber;

an ejection duct connecting the hollow chamber with the nozzle;

an intake valve disposed in the intake duct;

a drive device for the piston; and a device for manually providing mechanical energy into the drive device, wherein the drive device comprises a storage device for mechanical energy and is arranged outside the storage container, the drive device applying the mechanical energy to the piston, wherein the nozzle comprises a swirl nozzle providing the fluid flowing through the nozzle with circulation, wherein the storage device for mechanical energy comprises a spring, and wherein the storage container is provided within a center of the spring.

21. The atomizer according to claim 20, wherein the spring acts as a pressure spring and comprises at least one of a helical spring and a disk spring.

22. An atomizer for manual actuation, with which a partial quantity is atomized from a fluid supply and which comprises within a housing:

a storage container for the fluid that is to be atomized;

a nozzle for the fluid that is to be atomized;

a piston displaceable within a cylinder;

a hollow chamber within the cylinder in front of the piston;

an intake duct connecting the storage container with the hollow chamber;

an ejection duct connecting the hollow chamber with the nozzle;

an intake valve disposed in the intake duct;

a drive device for the piston; and a device for manually providing mechanical energy into the drive device, wherein the drive device comprises a screw-thrust transmission device and a storage device for mechanical energy and is arranged outside the storage container, the drive device applying the mechanical energy to the piston, wherein the nozzle comprises a swirl nozzle providing the fluid flowing through the nozzle with circulation, and wherein the storage device for mechanical energy comprises a gas spring.

23. The atomizer according to claim 22, wherein gas spring comprises a roll bellows gas spring.

* * * * *